United States Patent [19]

Tsumura

[11] 4,150,650

[45] Apr. 24, 1979

[54] INTERNAL-COMBUSTION ENGINE GOVERNOR WITH MEANS TO PREVENT UNNECESSARY CHANGES IN ENGINE SPEED DUE TO INERTIA OR GRAVITY

[75] Inventor: Yuzo Tsumura, Oyama, Japan

[73] Assignee: Kabushiki Kaisha Komatsu Seisakusho, Tokyo, Japan

[21] Appl. No.: 804,071

[22] Filed: Jun. 6, 1977

[30] Foreign Application Priority Data

Jun. 4, 1976 [JP] Japan ..... 51-64640

[51] Int. Cl.[2] ..... F02D 1/04

[52] U.S. Cl. ..... 123/140 R; 123/103 A

[58] Field of Search ..... 123/140 R, 140 MC, 103 A, 123/110, 113; 74/513, 603

[56] References Cited

U.S. PATENT DOCUMENTS

| | | | |
|---|---|---|---|
| 458,975 | 9/1891 | Nordberg | 123/140 R |
| 1,572,365 | 2/1926 | Rotter | 123/140 R |
| 2,167,951 | 8/1939 | Janicke | 123/140 R |
| 2,721,072 | 10/1955 | Zuhn et al. | 123/140 R |
| 2,986,291 | 5/1961 | Schick | 123/140 R |
| 3,923,025 | 12/1975 | Isobe et al. | 123/140 R |

FOREIGN PATENT DOCUMENTS

| | | | |
|---|---|---|---|
| 511810 | 1/1976 | Japan | 123/140 R |

*Primary Examiner*—Charles J. Myhre
*Assistant Examiner*—P. S. Lall
*Attorney, Agent, or Firm*—Armstrong, Nikaido, Marmelstein & Kubovcik

[57] ABSTRACT

In a centrifugal governor of the direct-acting type provided to the fuel injection pump of a compression-ignition engine on a vehicle, a counterbalance is provided which is movable in the forward and rearward directions of the vehicle by inertia or gravity. This counterbalance is connected via a lever fulcrumed at its intermediate point to the tension lever within the governor housing and, in another embodiment, to the rack which controls the injection pump delivery. Thus, as the movable governor members tend to be displaced either forwardly or rearwardly of the vehicle by inertia or gravity, the counterbalance functions to oppose their displacement and hence to restrain the governor from unnecessarily increasing or decreasing the engine speed.

4 Claims, 2 Drawing Figures

INTERNAL-COMBUSTION ENGINE GOVERNOR WITH MEANS TO PREVENT UNNECESSARY CHANGES IN ENGINE SPEED DUE TO INERTIA OR GRAVITY

BACKGROUND OF THE INVENTION

1. Field of the Invention

This invention relates to governors and more particularly to centrifugal governors for use with internal-combustion engines for vehicles. Even more particularly, the invention pertains to improvements designed to prevent such a governor from unnecessarily increasing or decreasing the engine speed as a result of displacement of some of its constituent members by inertia or by gravity.

2. Description of the Prior Art

A problem has been existent in connection with the centrifugal governors of diesel or compression-ignition engines incorporated in the power plants of construction or industrial vehicles. Since the fuel injection pump of such an engine usually extends in the front-to-rear longitudinal direction of the vehicle, the fuel delivery rate of the pump is easy to be unnecessarily increased or decreased when the vehicle stands on slopes, declining forwardly or rearwardly, or when the vehicle is started or stopped abruptly. This is because the fuel metering rack, leverage, linkage and the like of the governor are then displaced in the forward or rearward direction of the vehicle by gravity or by inertia.

Japanese Patent Publication No. 51-1810, published on Jan. 21, 1976, discloses a centrifugal governor of the direct-acting type free from the above noted problem. This prior art device, however, succeeds in overcoming the problem only at the cost of substantial alteration of the usual governor construction.

SUMMARY OF THE INVENTION

It is an object of this invention to provide an internal-combustion engine governor with means for preventing same from unnecessarily changing the engine speed by the effects of inertia or gravity.

Another object of the invention is to attain the first recited object without modification of the construction of the governor in widespread use.

With these and other objects in view, this invention is directed to a centrifugal governor which controls the rate of fuel delivery by the fuel injection pump of an internal-combustion engine and which includes a member tending to be displaced in predetermined opposite directions by inertia or by gravity to cause undesired changes in the rate of fuel delivery by the pump. Characteristically, the invention provides a device comprising a counterbalance adapted to tend to be displaced in the said predetermined opposite directions by inertia or by gravity, and means operatively connecting the counterbalance to the said members so as to cause the former to act against the latter when they tend to be displaced in either of the predetermined opposite directions.

The member to which the counterbalance is connected as above can be either the tension lever or the fuel-metering rack. In either case the device of this invention can be attached without modifications of the existing governor construction. The counterbalance can be connected to the lever or rack via a lever fulcrumed at its intermediate point.

The above and other objects, features and advantages of this invention and the manner of attaining them will become more apparent, and the invention itself will best be understood, from the following description and claims, taken in conjunction with the accompanying drawings showing preferred embodiments of the invention.

DESCRIPTION OF THE PREFERRED EMBODIMENTS

Figure 1:
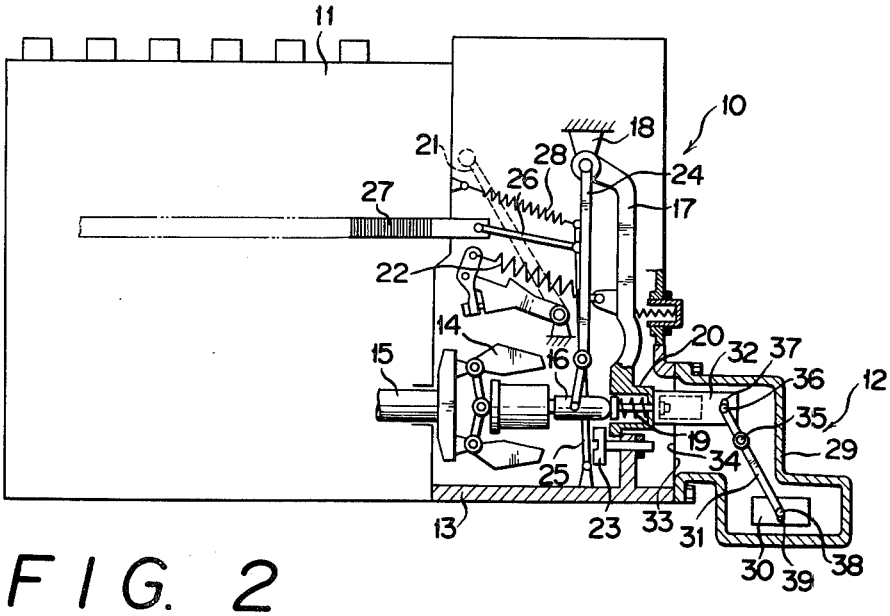
FIG. 1 is a schematic vertical sectional view of a centrifugal governor including the device in accordance with this invention, with the governor being shown together with a fuel injection pump.

In FIG. 1 of the accompanying drawings this invention is shown adapted for a centrifugal governor of the direct-acting type, generally designated 10, provided to a fuel injection pump 11 of a compression-ignition engine, not shown, in order to control the rate at which fuel is furnished to the engine cylinders by the pump so as to maintain the engine speed at or near a desired value. The device of this invention is generally designated 12 and is shown attached to a governor housing 13, as will be later described in detail.

The centrifugal governor 10, as well as the fuel injection pump 11, can be of prior art design, with the governor including a flyweight assembly 14 within the housing 13 which is mounted on an engine-driven camshaft 15 extending through the fuel injection pump 11 in order to sense the speed of the engine. The flyweight assembly 14 is provided with a shifter 16 which is adapted to move back and forth in predetermined opposite directions (forwardly and rearwardly of the vehicle) in accordance with the variable centrifugal force of the flyweights.

Seen at 17 is a tension lever which is pivoted at its top end to a bracket 18 affixed to a stationary part within the governor housing 13. The tension lever 17 has its bottom end disposed for abutment against the shifter 16 via an adapter spring 19 accommodated in a hollow boss 20 of the lever. At its intermediate point the tension lever 17 is connected to a control lever 21, which is located outside of the governor housing 13, via a tension spring 22 known as the governor spring. The tension lever is therefore urged clockwise into abutment against the shifter 16 under the force of the governor spring 22 which is adjustably variable by the control lever 21. An adjustable full load stop in the form of a bolt is provided at 23 for limiting the clockwise pivotal motion of the tension lever 17.

The shifter 16 is further operatively connected to the bottom end of a guide lever 24 which is supported at its top end for pivotal motion about the same axis as the tension lever 17, so that the guide lever is pivotable with the back-and-forth motion of the shifter. In addition, the guide lever 24 is operatively connected at a point adjacent its bottom end to an intermediate point of a floating lever 25 which is pivoted at its bottom end on the bottom of the governor housing 13.

At its top end the floating lever 25 is pivotally connected to one end of a link 26, the other end of which is pivotally connected to a fuel-metering member such as a rack 27 which controls the amount of fuel delivered by the fuel injection pump 11 by being moved back and forth relative to the latter in the same directions as the shifter 16. A relatively light tension spring 28 extends between the top end of the floating lever 25 and the governor housing 13 thereby biasing the fuel metering rack 27 in such a direction that the rate of fuel delivery is increased.

The centrifugal governor 10 of the foregoing construction operates in the well known manner to maintain the engine speed at or near a value set manually by the control lever 21, as the shifter 16 is moved back and forth by the centrifugal force of the flyweight assembly 13, against or under the force of the governor spring 22. The other details of construction and operation of this governor are believed clearly apparent to one skilled in the art.

The device 12 of this invention comprises an enclosure 29 suitably fastened rigidly to the governor housing 13, a counterbalance 30 accommodated within the enclosure and thereby constrained to back-and-forth movement in the same directions as the shifter 16 or fuel-metering rack 27 due to inertia or gravity, and a lever 31 operatively connecting the counterbalance to the tension lever 17 via a connector 32.

For connecting the counterbalance 30 to the tension lever 17, this invention takes advantage of an opening 33 formed conventionally in the governor housing 13 for manual adjustment of the full load stop 23 and other purposes. The enclosure 29 is so attached to the governor housing 13 that an opening 34 in the former directly communicates with the opening 33 in the latter. The connector 32 is rigidly attached to the boss 20 of the tension lever 17 so as to be in axial alignment with the shifter 16, and projects out of the governor housing 13 into the enclosure 29.

The lever 31 is pivotally mounted within the enclosure 29 at an intermediate point 35 which is shown to be closer to the upper end of the lever than to its lower end. This lever has a pin 36 at its upper end which is slidably engaged in a guide slot 37 formed in that end of the connector 32 which projects into the enclosure 29. Another similar pin 37 at the lower end of the lever 31 is slidably engaged in a guide slot 39 formed in the counterbalance 30.

In the operation of the device 12 in accordance with this invention, let it be supposed that the vehicle having the engine together with the centrifugal governor 10, the fuel injection pump 11 and the inventive device 12 declines forwardly with the result that the rate of fuel delivery by the pump tends to be increased, as the fuel-metering rack 27, the tension lever 17 and other movable governor members tend to be displaced by gravity in one of the aforesaid predetermined opposite directions (leftward or clockwise as viewed in FIG. 1). Since then, however, the counterbalance 30 tends also to be displaced leftward by gravity, the tension lever 17 receives the force of the counterbalance in the counterclockwise direction via the lever 31 and the connector 32. As a consequence, the governor 10 is prevented from unnecessarily increasing the fuel delivery rate of the pump 11 and hence the speed of the engine.

When the vehicle declines rearwardly with the result that the rate of fuel delivery by the pump 11 tends to be decreased by gravity, the device 12 of this invention operates to impart the force of the counterbalance 30 to the tension lever 17 in its clockwise direction. The governor 10 is therefore restrained from unnecessarily decreasing the fuel delivery rate of the pump. The device 12 operates in an identical manner upon abrupt starting or stopping of the vehicle to prevent the governor from unnecessarily decreasing or increasing the fuel delivery rate by inertia.

Figure 2:
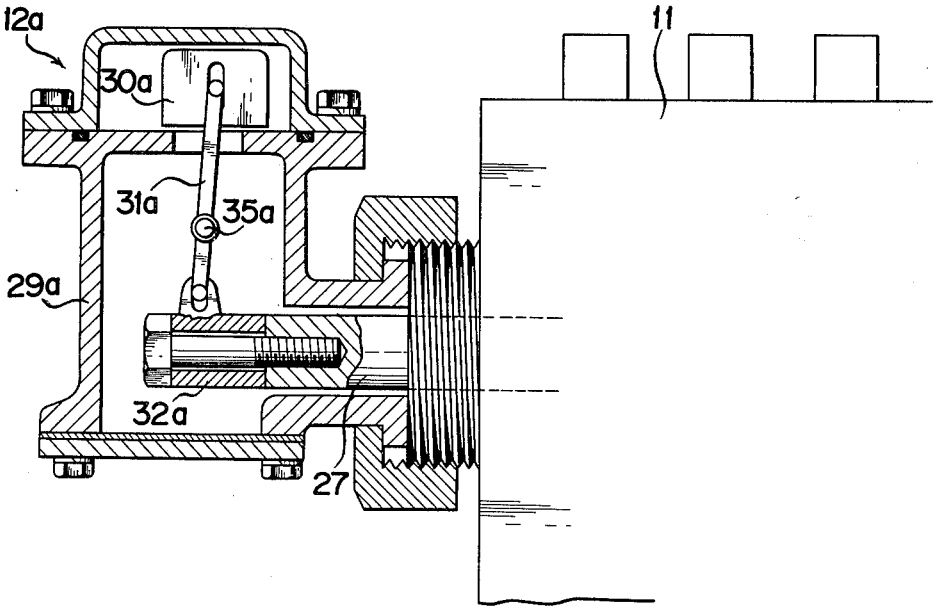
FIG. 2 is a vertical sectional view of another preferred embodiment of the invention.

FIG. 2 illustrates another preferred embodiment of this invention, wherein the device **12*a* in accordance with the invention is attached to the end of the fuel-metering rack 27 projecting forwardly of the fuel injection pump 11. The construction of the device 12*a* itself is substantially identical with that of the device 12, except that the counterbalance is disposed above the connector in the former. Various parts of the device 12*a* are therefore identified in FIG. 2 by the same reference numerals as those used to designate the corresponding parts of the device 12, only with the letter a suffixed to such numerals, and their description will be omitted. The operation of the device 12*a* will also be evident from the foregoing description of FIG. 1**.

Although the present invention has been shown and described hereinabove in terms of its specific embodiments, these embodiments are considered illustrative only of the principles of the invention. It is further not desired to limit the invention to the exact details of this disclosure, since numerous modifications or changes will readily occur to those skilled in the art without departing from the spirit or scope of the invention as expressed in the following claims.

What I claim is:

1. In a centrifugal governor for automatically controlling the rate at which fuel is delivered by a fuel injection pump, wherein the governor includes a housing, a fuel metering member adapted to be inserted in the fuel injection pump, and a tension lever pivotally connected to said housing at the top end thereof, said fuel metering member and said tension lever being adapted to be displaced relative to said housing in predetermined opposite directions by inertia or by gravity to cause changes in the rate of fuel delivery by the fuel injection pump, the improvement comprising a counterbalance means for displacement in said predetermined opposite directions by inertia or by gravity, and connector means operatively connecting said counterbalance means to said tension lever such that said counterbalance means acts against said tension lever when they are displaced in either of said predetermined opposite directions, whereby changes in the rate of fuel delivery by the fuel injection pump as a result of inertia or gravity are prevented.

2. The invention of claim 1, wherein said connecting means comprises a lever pivotally supported at its intermediate point and operatively connected at one end to said member and at the other end to said counterbalance means.

3. The invention of claim 2, wherein said connecting means further comprises a connector rigidly attached to said member, said lever being connected to said member via said connector.

4. In a centrifugal governor for automatically controlling the rate at which fuel is delivered by a fuel injection pump, wherein the governor includes a housing, a fuel metering member adapted to be inserted in the fuel injection pump, and a tension lever pivotally connected to said housing at the top end thereof, said fuel metering member and said tension lever being adapted to be displaced relative to said housing in predetermined opposite directions by inertia or by gravity to cause changes in the rate of fuel delivery by the fuel injection pump, the improvement comprising a counterbalance means for displacement in said predetermined opposite directions by inertia or by gravity, and connector means operatively connecting said counterbalance to said fuel metering member such that said counterbalance means acts against said fuel metering means when they are displaced in either of said predetermined opposite directions, whereby changes in the rate of fuel delivery by the fuel injection pump as a result of inertia or gravity are prevented.

* * * * *